United States Patent [19]

Fletcher

[11] Patent Number: 5,069,121

[45] Date of Patent: Dec. 3, 1991

[54] APPARATUS HAVING PIVOTABLE ARM FOR CRUSHING CANS

[76] Inventor: John S. Fletcher, 1508 58th St. North, St. Petersburg, Fla. 33710

[21] Appl. No.: 548,268

[22] Filed: Jul. 5, 1990

[51] Int. Cl.[5] ..... B30B 7/00; B30B 1/04

[52] U.S. Cl. ..... 100/137; 100/233; 100/293; 100/902; D 15/123

[58] Field of Search ..... 100/137, 233, 236, 293, 100/902; D 15/123

[56] References Cited

U.S. PATENT DOCUMENTS

| | | | |
|---|---|---|---|
| D. 240,074 | 5/1976 | Smith | 100/902 X |
| 334,212 | 1/1886 | Badger | 100/233 |
| 886,401 | 5/1908 | Pickett | 100/293 X |
| 2,161,931 | 6/1939 | Pattison | 100/233 |
| 2,905,079 | 9/1959 | Brock | 100/902 X |
| 3,667,386 | 6/1972 | Workman | 100/233 |
| 3,948,164 | 4/1976 | Pobuda et al. | 100/293 X |
| 4,058,054 | 11/1977 | Markman | 100/233 |
| 4,333,397 | 6/1982 | Modes | 100/233 |
| 4,383,480 | 5/1983 | Jerden | 100/233 X |

FOREIGN PATENT DOCUMENTS

| | | | |
|---|---|---|---|
| 786764 | 9/1935 | France | 100/233 |
| 58-23598 | 2/1983 | Japan | 100/902 |
| 1-218799 | 7/1989 | Japan | 100/902 |
| 282745 | 8/1952 | Switzerland | 100/233 |
| 2058656 | 4/1981 | United Kingdom | 100/233 |

*Primary Examiner*—Philip R. Coe
*Assistant Examiner*—Stephen F. Gerrity
*Attorney, Agent, or Firm*—Walter J. Monacelli

[57] ABSTRACT

The can crushing device disclosed herein comprises two parts. One part uses a relatively narrow bar to bend inwardly the middle of the can, preferably one made of aluminum. This step also tilts the ends of the can inwardly, thereby making it more susceptible to be more easily crushed into one compact, relatively flat piece. This second step is effected by a second part which comprises a base portion on which the partially bent can is positioned and an upper movable portion which is pivotally connected to the base portion.

12 Claims, 5 Drawing Sheets

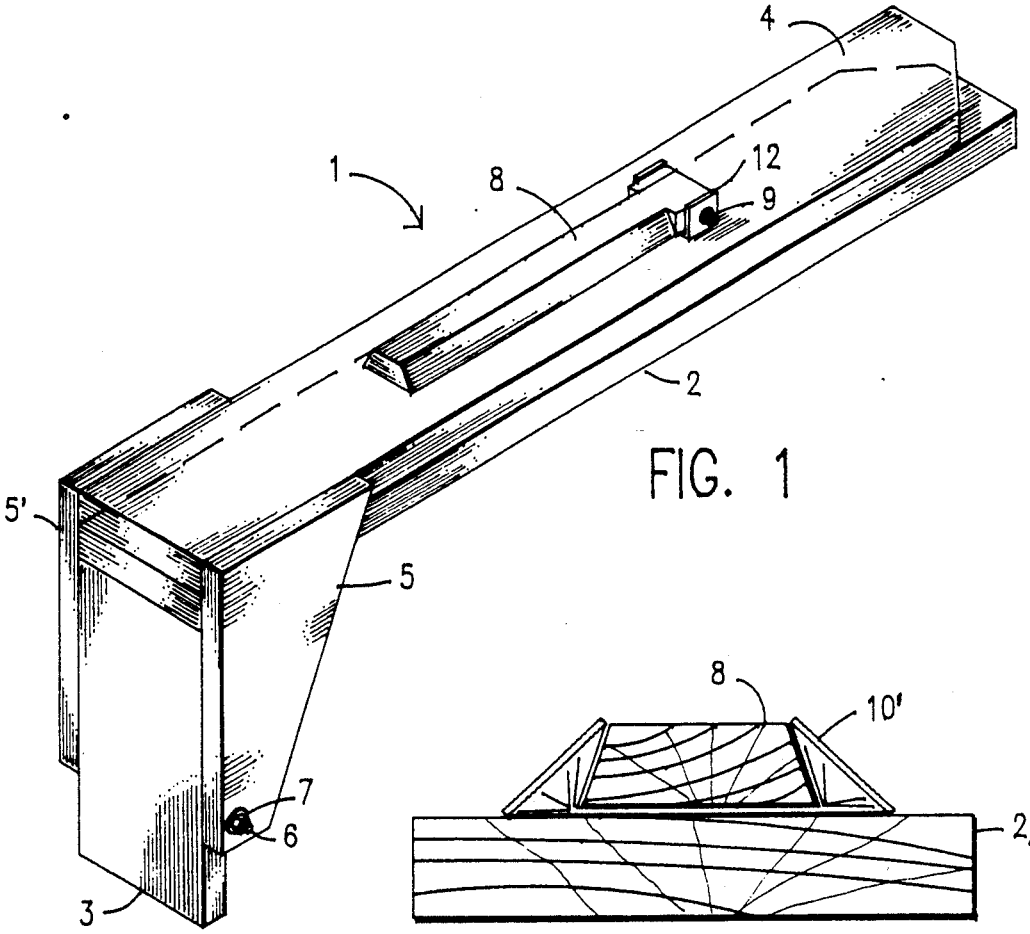
FIG. 1
FIG. 2
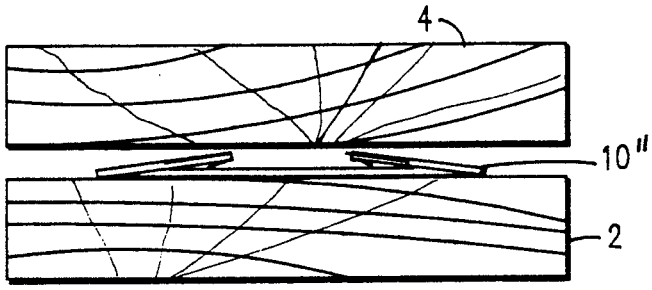
FIG. 3

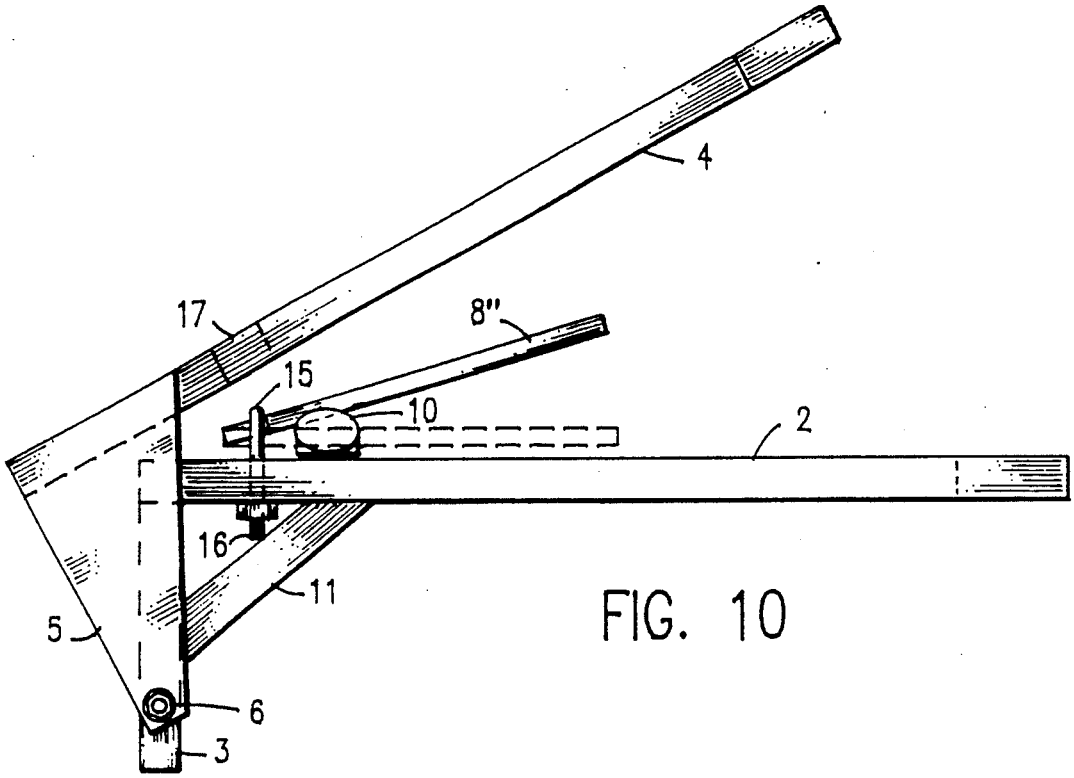
FIG. 10
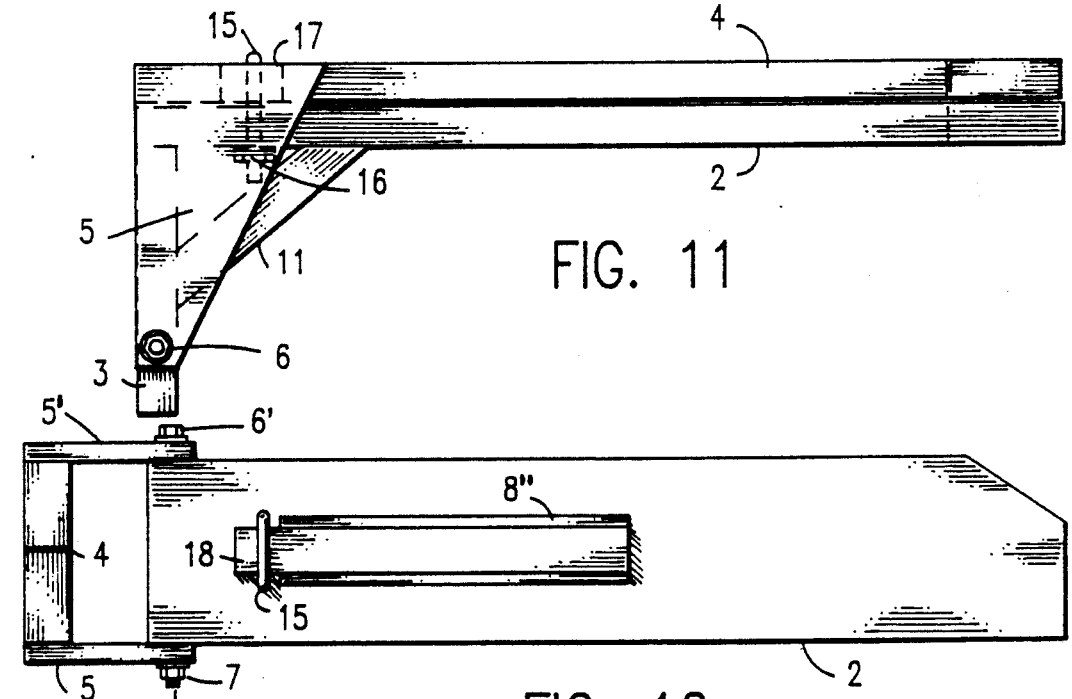
FIG. 11
FIG. 12

APPARATUS HAVING PIVOTABLE ARM FOR CRUSHING CANS

BACKGROUND OF THE INVENTION

1. Field of the Invention

This invention relates to a device for crushing empty metal cans, such as aluminum cans. More specifically it relates to a two part compactor in which a first part bends in or caves in the middle portion of the can. Still more specifically the second part of the compactor crushes the thus bent can into one compact piece. Even more specifically the two part compactor may be combined in one device by having the first part positioned on or fastened to the second part.

2. State of the Prior Art

Both for ecological or environmental reasons and for the recovery of a valuable metal, metal cans, particularly aluminum cans, are being collected and deposited in recycling collection depots. In order to reduce the volume occupied by the collected cans it is desirable to crush the cans to minimize the volume occupied. Since cans are often collected by individuals who do not have the space or containers in which to store these cans until they are taken to a collection depot. It is desirable therefore to have a simple device to crush the cans into compact units.

The desire and need for such a compactor is illustrated by the number of patents directed to such devices. Typical are the following U.S. pat. nos.: 1,402,433; 2,466,907; 2,603,271; 2,800,160; 2,905,079; 4,292,891; 4,333,396; 4,393,765; 4,442,768; 4,459,905; 4,532,861; 4,561,351; 4,884,502 and Design Patents 268,761 and 287,015. Most of these are complicated devices which attempt to crush the cans by pressure applied to the ends of the cans or by initially crushing the ends of the cans.

OBJECTIVES

It is an object of this invention to have a simple device to initiate the crushing of the can by attacking the vulnerable sidewall of the can.

It is also an object of this invention to have the can conditioned to a more easily crushable shape by this sidewall crushing which tilts the ends of the cans to a more easily crushable state.

It is also an object of this invention to have a simple inexpensive device which will complete the crushing of cans to compact flat pieces.

These and other objectives as described hereinafter are capable of being met by the device of this invention.

STATEMENT OF THE INVENTION

In accordance with the present invention it has been found that the above objectives are fully met by the operation of the device of this invention. This device comprises a base plate on which a partially crushed can, such as an aluminum beverage can, is positioned, and a movable arm which can be moved downward to lie flat on the base plate. The base plate and the arm each have one or two legs extending downward from the end thereof, the respective ends of the base plate and the movable arm are adjacent to each other. The leg or legs of the movable arm is pivotally attached to the leg of the base plate by one or preferably two hinges or pivot bolts at a point or points spaced from the base plate, preferably at a distance of 6 to 10 inches from the base plate. By lifting that end of the movable arm opposite the end attached to the leg of the base plate, as described above, the leg of the movable arm is pivoted with respect to the base plate leg and the movable arm is lifted away from the base plate. While the movable plate is in such a raised position, a partially crushed can may be positioned on the base plate and the movable arm moved back toward the base plate resulting in the complete and compact crushing of the can.

The pivoting of the movable arm leg about the point of connection to the base plate leg allows a lowering of the movable arm onto a can on the base plate thereby applying force on the can more directly from the top of the can. In comparison, if the movable arm is hinged directly to the base plate, lowering of the movable arm produces wedge type action on the can which causes a skittering or sliding of the can on the surface of the base plate. The type of pivoting connection described above permits a can to be placed as close as 3–4 inches from the end of the base plate without lateral move of the can when the movable arm is lowered thereon. This means that all but about 4 inches of the length of the movable arm may be used as leverage in crushing the can.

As a preliminary step in preparing the can for use in the above crushing device, a narrow bar is applied against the side of a can to cause the side of the can to cave in and to tilt the ends of the can toward the middle of the can. When the crushing of the can is completed in the above-described device, the tilted ends of the can are brought flat against the rest of the can to give a compact, flat substantially uniform size for similar size cans.

The can crushing device of this invention has a number of advantages including ease of operation, uniformity of size in compacted product, sharp edges not produced in product, exertion of considerable pressure on can, can be used for different sizes of cans, etc.

In one modification of the invention the base plate and the movable arm may be made of 2×6 inch planks. The leg attached to the base plate may also be a 2×6 inch board and the legs attached to the movable arm may comprise two triangle pieces of ½ or ¾ inch plywood paneling with a pivot bolt passing through an opening in a lower angle of each of the triangular pieces or side plates and fastened into opposite sides of the base plate leg. In such a modification the base plate and the movable arm advantageously are approximately 36 inches long and the base plate leg may be approximately 12–18 inches long. The openings in the side plates may be positioned approximately 6–10 inches perpendicularly from the bottom of the movable arm. With the two side plates an open space is made available at the end of the base plate so that the crushed can can be slid off the end of the base plate into a container positioned under the base plate leg. Opposite corners of the unhinged ends of the base plate and the movable arm are cut off to facilitate lifting of the movable arm and holding down of the base plate. This device is advantageously placed on a counter or table with the legs hanging over the edge and above a container into which the crushed cans are to be dropped.

In a similar modification the base plate, the movable arm and the legs may be made of metal or a strong plastic provided they can give the required crushing strength.

In another modification the leg or legs for the movable arm may be one piece or two pieces hinged at the bottom end to the leg of the base plate so that the movable arm can be tilted as described above. In such modification two legs are preferred with a sufficient space between the two legs so that the crushed can can be dropped off the end of the base plate. With such legs on the movable arm it is desirable to reinforce their connection to the movable arm by right angle plates.

The above modifications can also have an auxiliary device for initiating the crushing of the can. This auxiliary device comprises a narrow bar, preferably 1.5 to 2 inches wide, which may be hinged at one end or otherwise provided with a fulcrum means so that the bar can be pressed against the side of a can. This causes the side of the can to be caved inwardly and the ends of the can to be tilted toward the middle of the can. This preliminary crushing prepares the can for the final, complete crushing to be effected by the crushing device described above. This auxiliary device can be positioned at any convenient location. However it is preferred to have this fastened either to the top of the movable arm or to the top of the base plate near the end farthest from the end attached to the leg.

SPECIFIC EMBODIMENT OF THE INVENTION

The device of this invention may be further described by reference to the drawings in which:

FIG. 1 is a perspective view of a preferred modification of the device of this invention.

FIG. 2 is a cross-sectional end view of a preliminary step in the crushing of a can.

FIG. 3 is a cross-sectional end view of the device of this invention showing how a can is completely crushed by the device of this invention.

FIG. 10 is a side elevational view similar to that of FIG. 7 except that a different type of auxiliary, preliminary crushing device is shown.

FIG. 11 is a view similar to that of FIG. 10 except that the crushing arm is in a lowered position.

FIG. 12 is a top view of the device of FIG. 10 with the crushing arm raised to an upright position.

Figure 4:
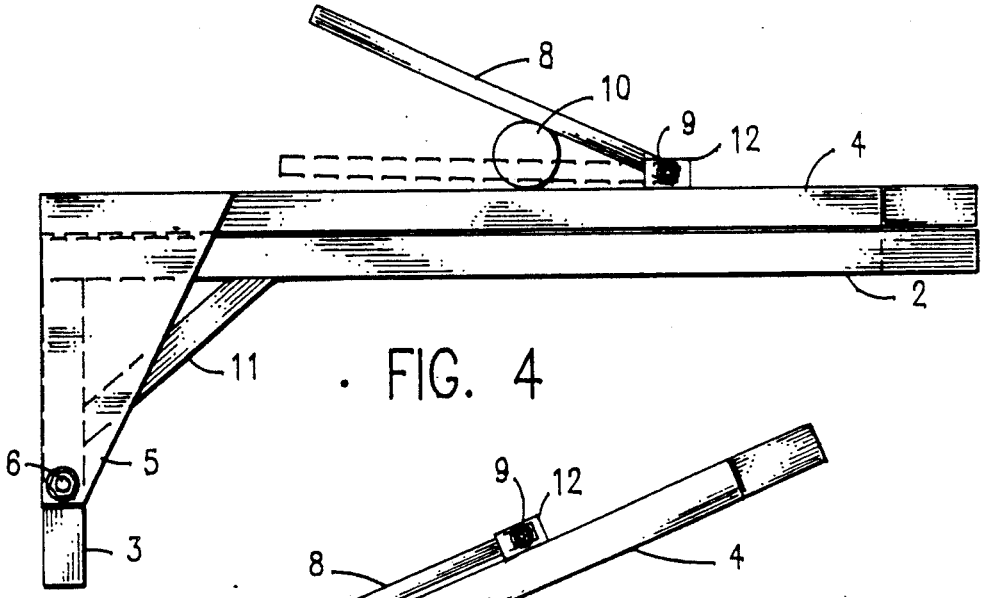
FIG. 4 is an elevational side view of the modification of FIG. 1 with a can positioned for the preliminary caving in of the side of a can.

In these drawings compact crusher 1 has a base plate 2 with leg 3 extending downward at one end. Arm 4 has two legs or panels 5 and 5' extending downward from one end thereof in the vicinity of leg 3. Legs 5 and 5' are pivotally joined to leg 3 by bolt 6. Nut 7 may be used to retain bolt 6 in position. An auxiliary bar 8 may be positioned on the upper surface of arm 4 and fastened thereto by pivoting means or hinge 9. As described hereinafter this auxiliary bar may be positioned elsewhere but is used to press the side of a can to cause an initial caving in of the sidewall of the can. In FIG. 2 this initial crushing of can 10 by bar 8 is shown. Bar 8 is shown in a preferred truncated prism cross-section. This preliminary crushing of the can causes the ends of the can to be tilted inwardly toward the center of the can.

Figure 5:
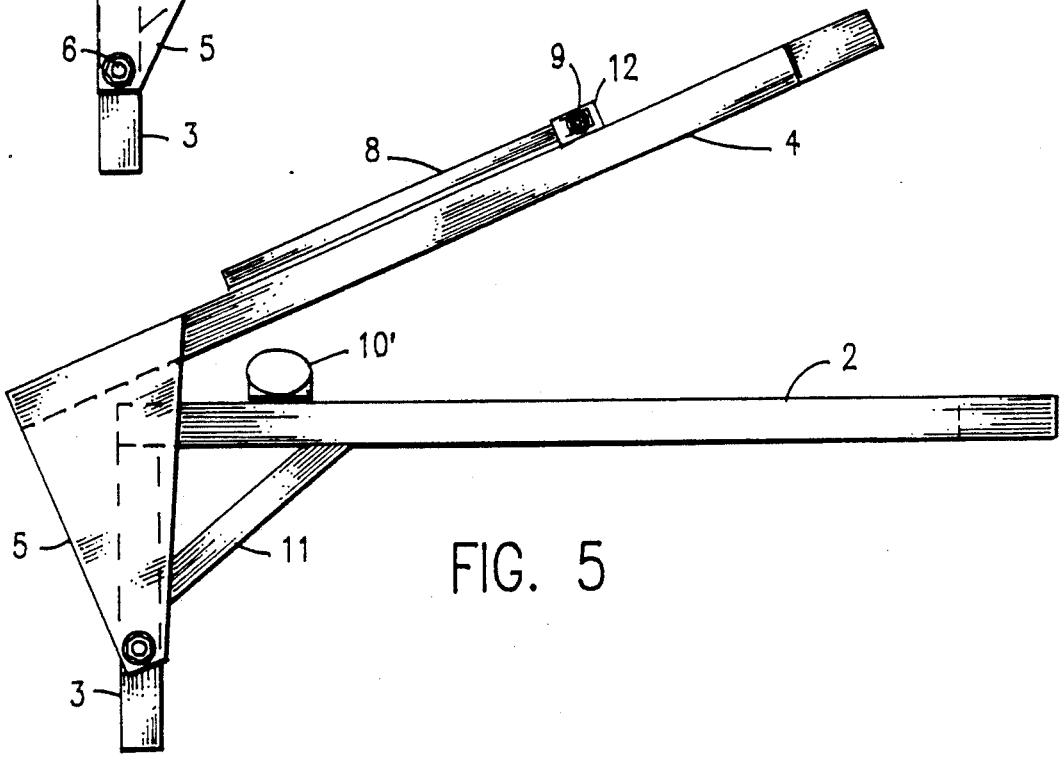
FIG. 5 is an elevational side view of the modification of FIG. 1 in an opened position for the positioning of a partially crushed can for further complete crushing.

After the preliminary crushing the can is placed on the base plate 2 while arm 4 is in a raised position as shown in FIG. 5. Preferably can 10 is positioned approximately 4–10 inches from the joined end of base plate 2.

FIG. 3 shows by cross-section of arm 4 and base plate 2 the resulting crushed condition of can 10".

The side view of FIG. 4 shows bar 8 in a raised position and can 10 placed in position for preliminary crushing. Brace 11 is shown for strengthening the connection of leg 3 to base plate 2. Bracket 12 is fastened to arm 4 and provides a fulcrum support for pivot bar 9.

In the arm 4 raised position shown in FIG. 5, partially crushed can 10' is placed near the joined end of base plate 2 for final crushing upon the lowering of arm 4 thereon.

Figure 6:
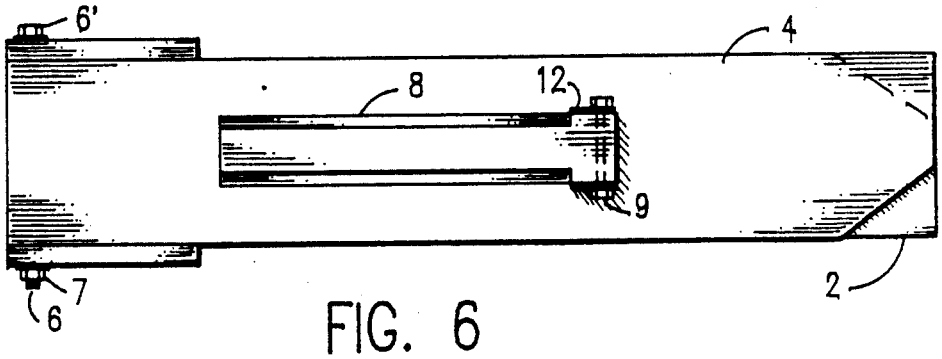
FIG. 6 is a top view of the modification of FIG. 1.

FIG. 6 shows a top view of the crushing device shown in FIG. 1.

Figure 7:
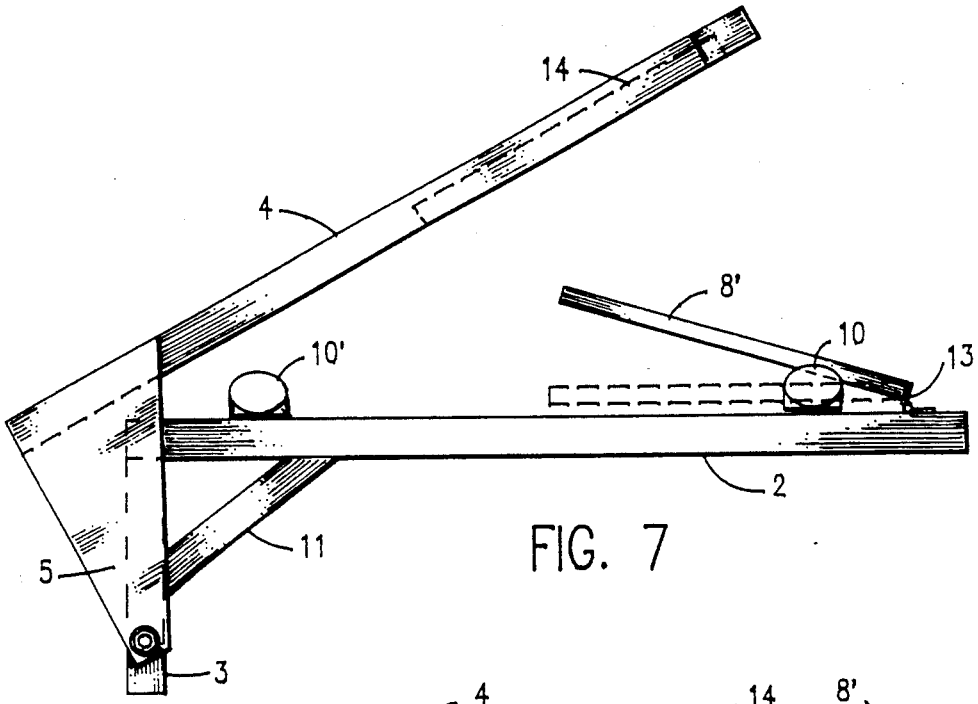
FIG. 7 is a side elevational view of another modification of the device of this invention with the preliminary crushing apparatus positioned in a different location.

FIG. 7 shows a modification of the device of this invention in which auxiliary bar 8' is positioned on the base plate, connected to base plate 2 by hinge 13, and a dotted section shows a recess 14 in arm 4 to receive bar 8' when arm 4 is lowered onto base plate 2. Can 10 is shown in position to be preliminarily crushed by bar 8' and partially crushed can 10' is shown in position on base plate 2 to be crushed by the lowering of arm 4.

Figure 8:
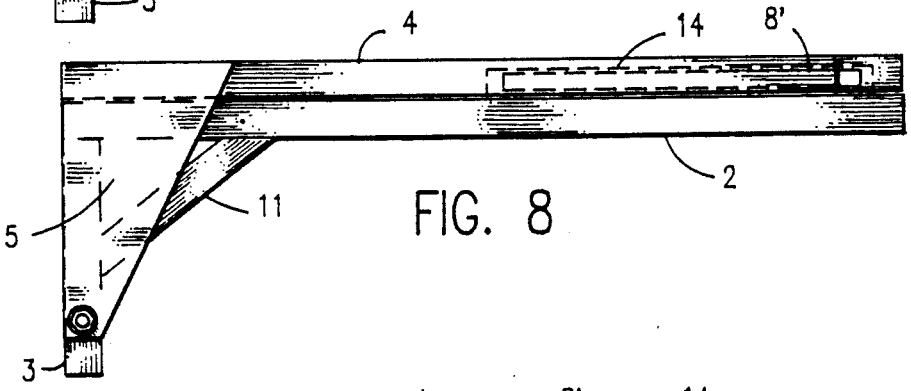
FIG. 8 is a similar view of the device of FIG. 7 with the crushing arm in a lowered position.
Figure 9:
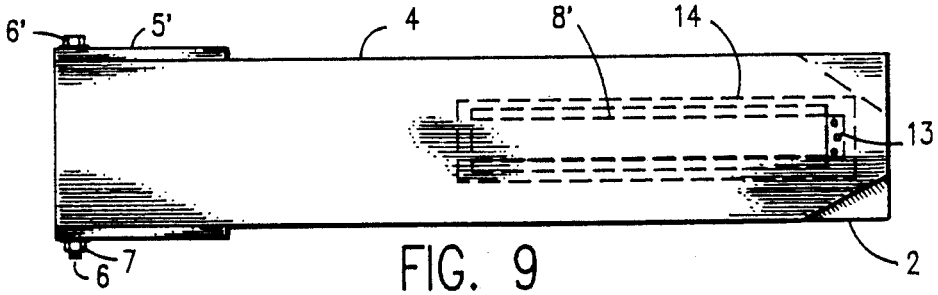
FIG. 9 is a top view of the modification of FIG. 8.
Figure 13:
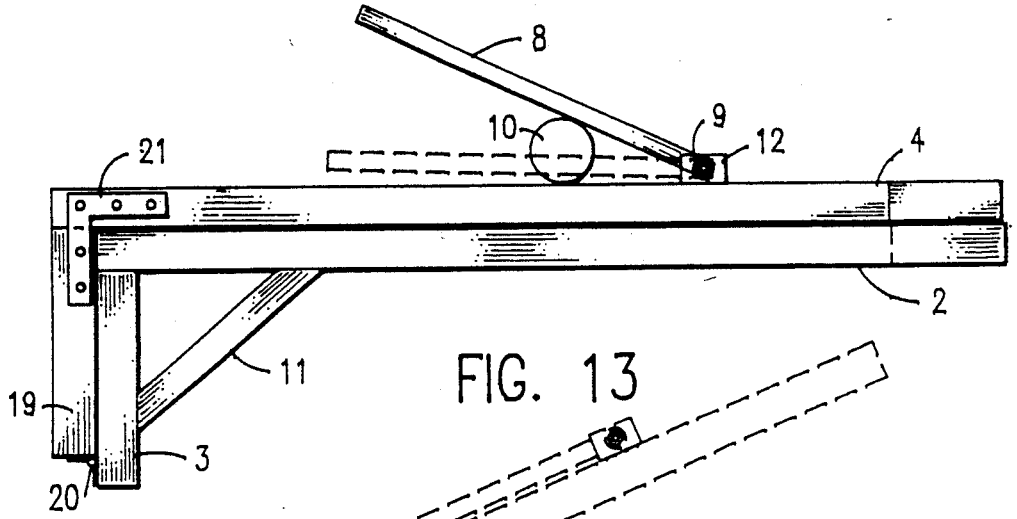
FIG. 13 is a side elevational view of another modification of the device of this invention.
Figure 14:
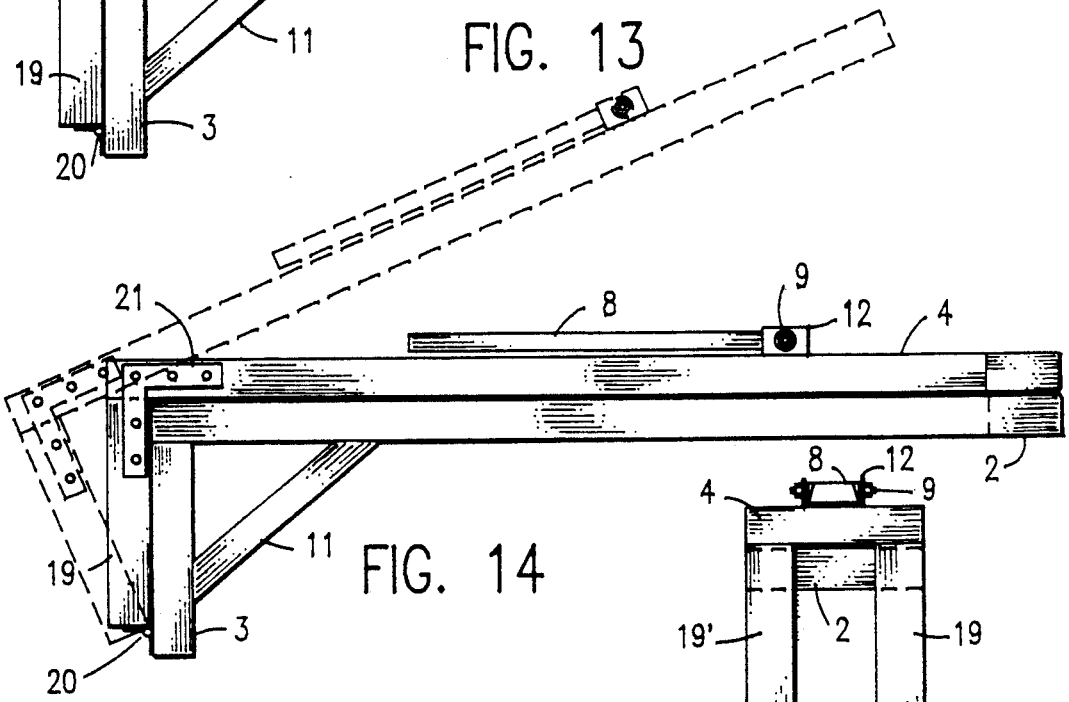
FIG. 14 is another side elevational view of the modification of FIG. 13 with the crushing arm shown in phantom in a raised position.
Figure 15:
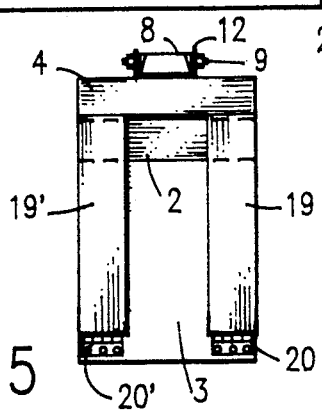
FIG. 15 is an end elevational view of the modification shown in FIG. 14.
Figure 16:
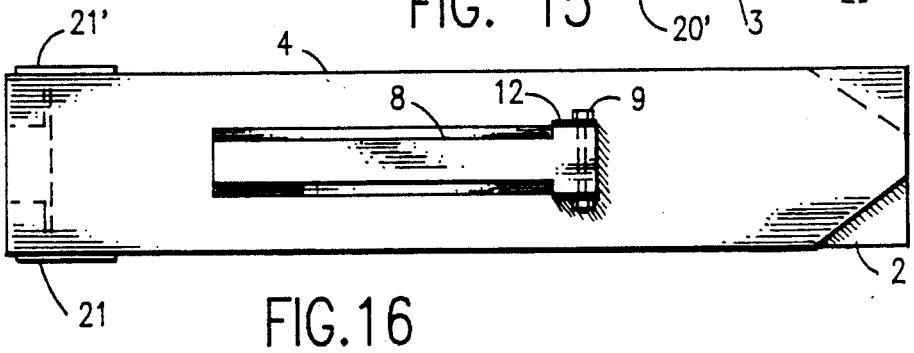
FIG. 16 is a top view of the modification shown in FIG. 14.

FIG. 8 shows arm 4 lowered onto base plate 2 and FIG. 9 is a top view of the modification of FIG. 8 with 6' shown as the head of bolt 6.

The modification shown in FIG. 10 has a modified auxiliary crushing device to give the preliminary sidewall crushing which comprises bar 8" and inverted U-shaped bracket 15 fastened to base plate 2 by nuts 16. The end of bar 8" is of a size and shape to fit into bracket 15 to provide a fulcrum means to accommodate the application of a downward force to bar 8" and thereby apply a crushing force to the sidewall of a can positioned under the bar. Opening 17 is provided in arm 4 so that when arm 4 is lowered as in the final crushing of a can, the bracket 15 will be received in this opening. This modification has the advantage that the can can be placed in an appropriate position for both the preliminary and the final crushing.

FIG. 12 shows the modification of FIG. 10 in which arm 4 is raised to an upright position. This view shows the tongue 18 at the end of bar 8" which fits into bracket 15.

FIGS. 13–16 show another modification of this invention in which two legs 19 and 19' are attached perpendicularly downward at the end of arm 4 and are connected at their bottoms to leg 3 of base plate 2 by hinges 20 and 20'. Angle braces 21 and 21' are used to strengthen the connections of the legs to arm 4.

As previously pointed out, an advantage of having an open space between the legs descending from arm 4 is that after the can is crushed and arm 4 is raised, the crushed can can be pushed off the end of the base plate, through the open space between the arm legs and into a container placed below that end of the crusher.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. A can crushing device comprising:

(a) a base plate having a width sufficient to accommodate thereon the length of the can to be crushed thereon, having a length substantially greater than the width and having at least one leg extending perpendicularly downward from one end thereof for a distance of 6 to 18 inches;

(b) an arm having a width sufficient to cover the length of the can to be crushed, having a length sufficient to give the leverage required for crushing the can, and having at least one leg extending perpendicularly downward from one end thereof for a distance of at least 6 inches, said arm having the other end of said arm unattached, and said leg on said arm being positioned adjacent to said leg on said base plate;

(c) a pivoting means positioned at least 6 inches below said base plate and connecting said leg on said arm to said leg on said base plate, and adapted to allow said arm to lay flat on said base plate and also to allow said arm to be moved away from said base plate by lifting the unattached end of said arm away from said base plate, whereby a can positioned on said base plate between said base plate and said arm can be crushed by a force applied to the unattached end of said arm and directed toward said base plate;

said device further including a bar having a width of 1.5–2 inches and a fulcrum means whereby said bar is adapted to cave in the side of the can to be crushed said bar being positioned at a convenient location on said device.

2. The device of claim 1 in which said bar is positioned on the top surface of said arm and said fulcrum means is a hinge fastening said bar to said arm.

3. The device of claim 2 in which said pivoting means is positioned 6–12 inches below said base plate.

4. The device of claim 1 in which said bar is positioned on the top surface of said base plate and said fulcrum means is a hinge fastening said bar to said base plate.

5. The device of claim 4 in which said bar is positioned near the unattached end of said base plate.

6. The device of claim 1 in which said bar may be positioned on said base plate, said fulcrum means comprises an inverted U-shaped bracket extending upward from said base plate into which an end of said bar may be inserted to provide a fulcrum means, and said arm has an opening therein of a size and positioned to receive said bracket when said arm is positioned flat on said base plate.

7. The device of claim 1 in which said arm has a length in the range of 24–40 inches.

8. The device of claim 7 in which said arm has a length of approximately 36 inches.

9. The device of claim 7 in which said base plate has a length in the range of 24–40 inches.

10. The device of claim 9 in which said base plate has a length of approximately 36 inches.

11. The device of claim 1 in which said pivoting means is positioned 6–12 inches below said base plate.

12. The device of claim 1 in which said pivoting means is positioned 6 inches below said base plate.

* * * * *